United States Patent [19]

Fenech

[11] Patent Number: 4,551,363

[45] Date of Patent: Nov. 5, 1985

[54] ELECTRO LUMINESCENCE VISUAL DEVICE

[76] Inventor: Brian Fenech, 3 Schernott Pl., Bellmore, N.Y. 11710

[21] Appl. No.: 606,282

[22] Filed: May 2, 1984

[51] Int. Cl.[4] ..... A44C 25/00

[52] U.S. Cl. ..... 428/28; 63/13; 362/102; 362/104; 428/917

[58] Field of Search ..... 63/12, 13; 40/544; 362/34, 84, 102, 104; 427/66; 428/28, 917; 313/639

[56] References Cited

U.S. PATENT DOCUMENTS

| | | | |
|---|---|---|---|
| 1,912,602 | 6/1933 | Stonberg | 428/28 X |
| 2,449,880 | 9/1948 | Cox | 313/485 |
| 2,506,800 | 5/1950 | MacLennan | 428/28 X |
| 2,817,236 | 12/1957 | Van Alstyne, Jr. | 128/736 |
| 3,790,775 | 2/1974 | Rosenblatt | 362/104 |
| 3,875,453 | 4/1975 | Thornton, Jr. | 313/642 X |
| 4,005,328 | 1/1977 | Radielovic et al. | 313/487 |
| 4,097,776 | 6/1978 | Allinikov | 427/66 X |
| 4,106,079 | 8/1978 | Drury | 362/102 X |
| 4,142,383 | 3/1979 | Eberhart | 428/28 X |
| 4,148,199 | 4/1979 | Boykin | 63/12 |
| 4,208,888 | 6/1980 | Erdman et al. | 428/28 X |
| 4,210,839 | 7/1980 | Hagen | 427/66 X |
| 4,230,995 | 10/1980 | Burnham | 372/56 |
| 4,405,973 | 9/1983 | Moscarillo | 428/40 X |
| 4,429,303 | 1/1984 | Aboelfotoh | 313/485 X |

*Primary Examiner*—Henry F. Epstein
*Attorney, Agent, or Firm*—Richard L. Miller

[57] ABSTRACT

An electroluminescence visual device which works on the principle that when liquid mercury rollably moves along the smooth surface of glass is an partially evacuated atmosphere the mercury will emit flashes of light. This effect is intensified by the replacement of air with gaseous helium to increase the production of photons. The embodiments resulting take the form of flashing pendant earrings, flashing drumsticks, illuminated spheres and hemispheres and decorative blisters. The faster the relative motion of the mercury the more intense the light emitted. This light may be used for decorative purposes of for emergency illumination.

11 Claims, 6 Drawing Figures

ELECTRO LUMINESCENCE VISUAL DEVICE

BACKGROUND OF THE INVENTION

The present invention relates generally to electrochemical devices which emit light.

When liquid mercury is admitted into a partially evacuated chamber of glass or quartz, and when this container is subsequently shaken, light is emitted as the mercury rolls about under this agitation. The first recorded observation of this affect appears to be that of the astronomer, Picard, who in 1675, noted a visible blue-white glow in the region of the Torricellian vacuum when a mercury barometer was shaken. At the turn of the 18th century, investigations of this effect were undertaken by Fra. Hauksbee and published in the Phil. Trans. Roy. Soc. London 24, No. 303, 2130 (1705). He made observations upon the glow resulting from the motion of the globules of mercury upon the walls of a glass container, noting that visual detection of light emission became impossible when the air pressure in the vessel became as much as one-half atmosphere in value.

Gay L. Dybwad and C. E. Mandeville published their work in this area in an article entitled: "Generation of Light by the Relative Motion of Contiguous Surfaces of Mercury and Glass" published in The Physical Review, 15 Sept. 1967, Second Series, Vol. 161, No. 3. Dybwad and Mandeville discovered that the emission of photons and thereby the intensity of emitted light was increased by the introduction of gaseous helium into the space between the liquid mercury and the inner surface of the container. Although light emission arises from the ionization and excitation throughout the entire volume, the glow is seen to be concentrated in the near vicinity of the departing edge of the mass of mercury, the edge away from which the glass surface moves.

Although this effect has been known for some time, it has not been used to provide emergency lighting or to provide decorative effects.

SUMMARY OF THE INVENTION

It is therefore a primary object of the present invention to provide an electroluminescence visual device which uses the principle of liquid mercury moving inside a sealed container to generate a light.

Another object is to provide an electroluminescence visual device which may be used as a pendant earring in which the mercury is contained in a tear drop shaped container so that when the wearer moves the earring emit flashes of light.

Another object is to provide an electroluminescence visual device which may be used as a pendant earring in which the mercury is contained in a container shaped like a curved tube so that when the wearer moves the earring emit flashes of light.

A yet further object is to provide an electroluminescence visual device which may be used as a drumstick which flashes light when the drummer is drumming.

A still further object is to provide an electroluminescence visual device which may be shaped like a hollow sphere.

A still further object is to provide an electroluminescence visual device which may be shaped like a hollow hemisphere which may be equipped with an adhesive on its flat surface so that it may be attached, for example, to a key ring so that a user may see his keys in the dark by shaking the hemisphere. This configuration may be used as an ornamental blister.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
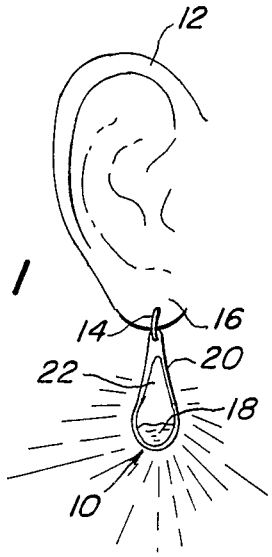
FIG. 1 is a perspective view of the first embodiment of the invention, shown as an earring.

In FIG. 1, the invention 10 is shown worn on an ear 12 by using a hook 14 which passes through pierced earlobe 16. Liquid mercury 18 partially fills the void formed by the chamber in the sealed tear shaped pendant enclosure 20. The space 22 above the liquid mercury 18 may be filled with air under a partial vacuum or helium under partial vacuum which increases the emission of light when the wearer's ear 12 is moved.

Figure 3:
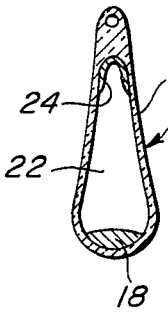
FIG. 3 is a cross sectional view taken along the axis of the earring shown in FIG. 1.

The invention 10 is shown enlarged in FIG. 3 with the addition of a conducting coating 24 which prevents the buildup or redistribution of electrical charges and thereby prevents the undesired emission of light when the invention 10 is inverted so that the liquid mercury 18 rests upon the conductive coating 24. This principle may be extended to any embodiment of the instant invention.

Figure 2:
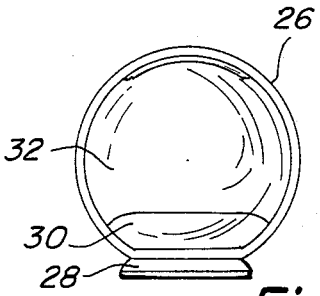
FIG. 2 is a second embodiment shown as an ornamental globe.

In FIG. 2 the invention is shown in the embodiment of a hollow sphere 26 with associated base 28. As in previous embodiments, the hollow sphere 26 is partially filled with liquid mercury 30 and the space 32 above the liquid mercury 30 is filled with either air or helium.

Figure 4:
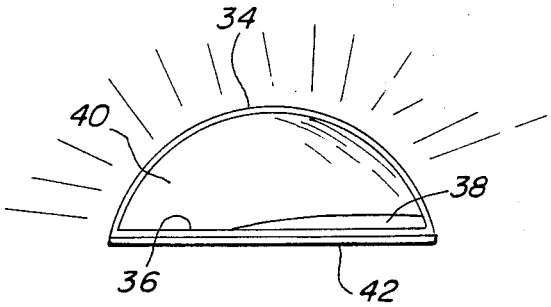
FIG. 4 is a third embodiment illustrated as an ornamental blister.

In FIG. 4 the invention is shown in the embodiment of a hollow hemisphere 34 with associated flat surface 36. As in previous embodiments, the hollow hemisphere 34 is partially filled with liquid mercury 38 and the space 40 above the liquid mercury is filled with either gas such as helium or a mixture of suitable gases. The flat surface 36 is either coated with an adhesive or may be provided with a pressure sensitive adhesive 42. Since hollow hemisphere 34 may be made any size, this embodiment may be used as a decorative light emitting blister.

Figure 5:
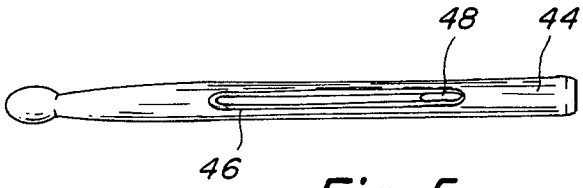
FIG. 5 illustrates the invention installed in a drum stick.

In FIG. 5 the invention is shown installed into a drum stick 44. A glass rod 46 is partially filled with liquid mercury 48 which emits light in a manner analogous to the embodiments already discussed.

Figure 6:
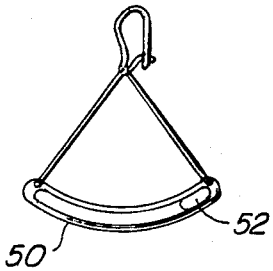
FIG. 6 is another embodiment of an earring.

The pendant earring shown in FIG. 6 consists of a curved glass tube 50 which is partially filled with liquid mercury 52 which emits light in a manner analogous to the embodiments already discussed.

It should be understood that although helium is specified in this text that there are many other gaseous fluids which will produce similar effects and helium is not to be considered as a limitation of the design, and is only suggested as a typical suitable gas.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An electroluminescence visual device, comprising, in combination liquid mercury and a sealed glass enclosure, said mercury only partially filling said enclosure so as to be free to move therein, said glass enclosure having at least a portion thereof unobstructed in the vicinity of the location of the mercury, whereby when said mercury moves in said enclosure, light is emitted arising from ionization and excitation throughout the entire volume of said enclosure, said light being visible therethrough at least in said unobstructed portion of the enclosure, and further comprising a sealed enclosure with a conducting region on a portion thereof for preventing the buildup or redistribution of electrical charges, wherein said mercury may move against said conducting surface region yet not emit light but will emit light on the other portions of the sealed enclosure.

2. An electroluminescence visual device, as recited in claim 1, further comprising a gas which fills the void left by the space between said liquid mercury and the inside volume of said enclosure.

3. An electroluminescence visual device, as recited in claim 2, wherein said gas is air, wherein maximum emission intensity occurs at a pressure of 25 mm of Hg. at room temperature.

4. An electroluminescence visual device, as recited in claim 2, wherein said gas is Helium which increases the intensity of said emitted light by increasing the yield of photons.

5. An electroluminescence visual device, as recited in claim 1, wherein said enclosure is a teardrop shaped pendant hung from a wearer's pierced earlobe by a hook whereby, when said wearer moves said pendant sways thereby causing said device to emit light.

6. An electroluminescence visual device, as recited in claim 1, wherein said enclosure is a pendant, formed into a curved sealed tube, hung from a wearer's pierced earlobe by a hook whereby, when said wearer moves said pendant sways thereby causing said device to emit light.

7. An electroluminescence visual device, as recited in claim 1, wherein said enclosure is a hollow sphere wherein when said hollow sphere moves said liquid rollably moves thereby causing said device to emit light.

8. An electroluminescence visual device, as recited in claim 1, wherein said enclosure is a hollow hemisphere wherein when said hollow hemisphere moves said liquid rollably moves thereby causing said device to emit light.

9. An electroluminescence visual device, as recited in claim 8, wherein an adhesive is placed on the flat surface of said hemisphere whereby said hemisphere may be attached to a planar surface.

10. An electroluminescence visual device, as recited in claim 9, wherein said adhesive is a pressure sensitive adhesive.

11. An electroluminescence visual device, as recited in claim 1, wherein said enclosure is a narrow sealed tube placed into a drumstick wherein a slot has been provided to permit unobstructed view of said tube, whereby when a drummer moves said drumstick said mercury rollably moves thereby causing said drumstick to emit light.

* * * * *